US006540250B1

(12) United States Patent
Peterson

(10) Patent No.: US 6,540,250 B1
(45) Date of Patent: Apr. 1, 2003

(54) HEIGHT ADJUSTABLE WHEELCHAIR

(76) Inventor: Clifford D. Peterson, 6250 Country Ridge La., Johnston, IA (US) 50131

( * ) Notice: Subject to any disclaimer, the term of this patent is extended or adjusted under 35 U.S.C. 154(b) by 0 days.

(21) Appl. No.: 09/569,510

(22) Filed: May 12, 2000

(51) Int. Cl.[7] ..... A61G 5/14
(52) U.S. Cl. ..... 280/657; 280/304.1; 297/DIG. 10
(58) Field of Search ..... 280/30, 647, 649, 280/650, 651, 304.1, 250.1; 297/35, 354.1, 311, 312, DIG. 10; 254/7 R, 7 C

(56) References Cited

U.S. PATENT DOCUMENTS

| | | | | | |
|---|---|---|---|---|---|
| 2,850,075 | A | * | 9/1958 | Wilson | 297/DIG. 10 |
| D184,040 | S | | 12/1958 | Crockett | |
| 3,769,638 | A | | 11/1973 | Clanan | 4/134 |
| 3,865,430 | A | | 2/1975 | Tanus | 297/217 |
| 3,881,771 | A | | 5/1975 | Amstutz | 297/71 |
| 4,067,409 | A | | 1/1978 | DiMatteo et al. | 180/6.5 |
| D252,080 | S | | 6/1979 | VonHeck | D12/131 |
| 4,274,503 | A | | 6/1981 | Mackintosh | 180/23 |
| 4,343,482 | A | * | 8/1982 | Wegner | 280/650 |
| 4,415,202 | A | | 11/1983 | Pew | 297/217 |
| 4,759,561 | A | | 7/1988 | Janssen | 280/242 |
| 4,860,987 | A | | 8/1989 | Werner | 248/405 |
| 4,893,826 | A | | 1/1990 | Ward et al. | 280/87 |
| 5,111,899 | A | | 5/1992 | Reimann | 180/65.1 |
| 5,112,076 | A | | 5/1992 | Wilson | 280/657 |
| 5,255,934 | A | * | 10/1993 | Wilson | 280/657 |
| 5,356,172 | A | * | 10/1994 | Levy et al. | 280/650 |
| 5,380,034 | A | | 1/1995 | Wilson | 280/657 |
| 5,405,187 | A | | 4/1995 | Söderlund | 297/312 |
| 5,409,250 | A | * | 4/1995 | Cstonyi | 280/304.1 |
| 5,542,744 | A | | 8/1996 | Bathrick | 297/362.11 |
| 5,577,753 | A | | 11/1996 | Pociask | 280/250.1 |
| 5,592,997 | A | | 1/1997 | Ball | 180/65.1 |
| 5,669,620 | A | | 9/1997 | Robbins | 280/250.1 |
| 5,690,185 | A | * | 11/1997 | Sengel | 280/304.1 |
| D398,565 | S | | 9/1998 | Knabusch et al. | D12/131 |
| 5,860,664 | A | * | 1/1999 | Smith | 280/250.1 |
| 5,984,333 | A | * | 11/1999 | Constantijn et al. | 280/250.1 |
| 6,113,188 | A | * | 9/2000 | Stewart et al. | 297/DIG. 10 |
| 6,209,901 | B1 | * | 4/2001 | Patel | 280/304.1 |
| 6,247,718 | B1 | * | 6/2001 | Gobbers et al. | 280/304.1 |

FOREIGN PATENT DOCUMENTS

| | | | | |
|---|---|---|---|---|
| DE | 3508081 | * | 9/1986 | 280/250.1 |
| EP | 328221 | * | 8/1989 | 280/250.1 |
| JP | 5-253260 | * | 10/1993 | 280/250.1 |

* cited by examiner

*Primary Examiner*—Frank Vanaman
(74) *Attorney, Agent, or Firm*—McKee, Voorhees & Sease, P.L.C.

(57) ABSTRACT

A wheelchair has a seat that can be raised or lowered to enhance use of the chair. The seat can also be tilted to facilitate entry into and exit from the wheelchair. The lift mechanism for raising, lowering and tilting the seat includes a pair of rotatable tubes mounted to a lower frame of the wheelchair, and a pair of screws threadably received in the tubes with an upper end connected to the seat. A battery operated reversible motor is operatively connected to the tubes to rotate the tubes in a first direction to extend the screws and thereby raise or tilt the seat. The motor is operable in an opposite direction to rotate the tubes so as to retract the screws, thereby lowering the seat. The frame of the wheelchair is U-shaped, such that the wheelchair can be backed into position around a toilet. The seat includes a pair of cushions that can be laterally opened to allow a person to use the toilet while seated in the wheelchair.

16 Claims, 9 Drawing Sheets

HEIGHT ADJUSTABLE WHEELCHAIR

BACKGROUND OF THE INVENTION

Wheelchairs having many different features have been long known, including height adjustable wheelchairs. However, a significant problem with such height adjustable wheelchairs resides in the lift mechanism, which typically is large and bulky so as to be able to lift people of all sizes. The convention drive mechanism generally includes a screw that is turned by a motor so as to raise and lower the chair. However, turning the screw requires a relatively large motor with sufficient horsepower. The extent of the lift is also limited by the drive train required to turn the screw. The bulky drive train also occupies substantial space in the wheelchair, which precludes the chair from being used in certain situations, for example, over a toilet for use of the toilet by a person in the chair. The construction of the chair and lift mechanism also makes the chair heavy, and therefore more difficult to maneuver.

Accordingly, a primary objective of the present invention is the provision of an improved wheelchair having a simple and compact lift mechanism for adjusting the height of the chair.

Another objective of the present invention is the provision of a wheelchair having a seat which is height adjustable and tiltable.

A further objective of the present invention is the provision of a wheelchair having a seat and upper frame member that can be raised to the level of a bed to facilitate transfer of a person between the bed and the wheelchair.

A further objective of the present invention is the provision of a height adjustable wheelchair having a U-shaped frame to allow the chair to be positioned over a toilet for use of the toilet by a person on the chair.

Another objective of the present invention is the provision of a wheelchair having a seat that can be tilted forwardly and raised so as to facilitate a person's entry and exit to and from the chair.

Another objective of the present invention is the provision of a wheelchair movable between a lowered position wherein a person's legs will fit beneath a table and a raised position wherein a person can reach objects on a shelf above a countertop.

Still another objective of the present invention is a provision of a wheelchair having caster wheels which automatically caster to provide an enlarged footprint when the chair is moved in one direction and a reduced footprint when the chair is moved in the opposite direction.

Still another objective of the present invention is the provision of a height adjustable wheelchair that is economical to manufacture, lightweight, and stable and safe in use.

These and other objectives will become apparent from the following description of the invention.

SUMMARY OF THE INVENTION

The height adjustable wheelchair of the present invention includes a lower frame member and an upper frame member. A seat has a forward edge pivotally connected to the upper frame member and a rearward edge releasably latched to the upper frame member. A lift mechanism extends between the lower frame member and the seat so as to raise the seat and upper frame member when the seat is latched to the upper frame member, and to tilt the seat forwardly when the seat is unlatched from the upper frame member.

The lift mechanism includes a pair of hollow tubes mounted on each side of the lower frame member in a vertical orientation. A threaded shaft or screw is threadably received within the tubes. A drive motor is operatively connected to each of the tubes via belts or chains so as to rotate the tubes, and thereby extend or retract the threaded shafts so as to raise or lower the seat, respectively. The wheelchair includes armrests with one or more switches for controlling actuation of the motor. The motor is powered by a battery mounted in the lower frame member.

The rear of the seat can also be unlatched from the upper frame member, such that the seat can be tilted forwardly when the screws are extended, thereby facilitating ingress and egress of a person to and from the chair.

Scissor-type braces are provided on the opposite sides and on the front of the wheelchair, and extend between the upper and lower frame members, so as to provide stability, particularly when the seat is moved to a raised position.

The lower frame member is U-shaped, with opposite side, a connected front and an open back, such that the wheelchair can be backed into position over a toilet. The seat includes a pair of cushions that can be opened laterally to allow a person sitting in the chair to use the toilet.

The wheelchair includes four wheels, with the two rear wheels preferably being caster wheels. When the wheelchair is rolled in a forward direction, the caster wheels caster to a rearward position so as to provide an enlarged footprint for the wheelchair, thereby enhancing stability. When the wheelchair is rolled rearwardly, the caster wheels caster to a forward position, thereby reducing the footprint, and facilitating positioning of the wheelchair over the toilet.

In use, the wheelchair is normally maintained in a lowered position with the threaded rods fully retracted. In such a lowered position, a person in the wheelchair can easily fit their legs beneath a table, for example during eating at a kitchen table. The seat and upper frame can be raised by actuating the motor to turn the tubes, thereby extending the screws. Preferably, the seat can be raised at least to the height of a bed to facilitate transfer of a person between the chair and the bed. Also, in a fully raised position, a person sitting in the chair can reach shelves in a cupboard above a countertop, such as in a kitchen.

DETAILED DESCRIPTION OF THE DRAWINGS

Figure 1:
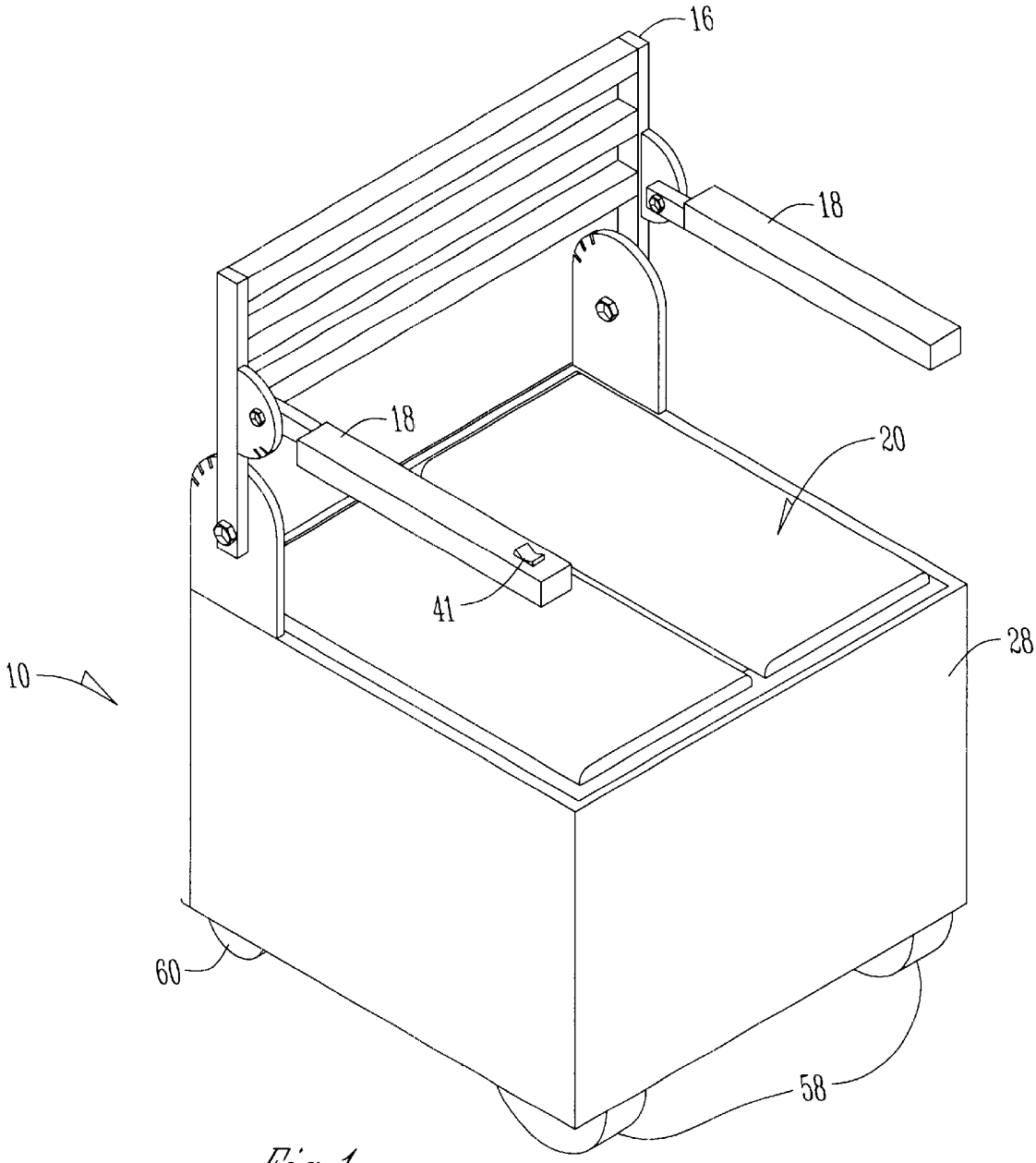
FIG. 1 is a perspective view of the wheelchair of the present invention with the seat in a lowered position.
Figure 2:
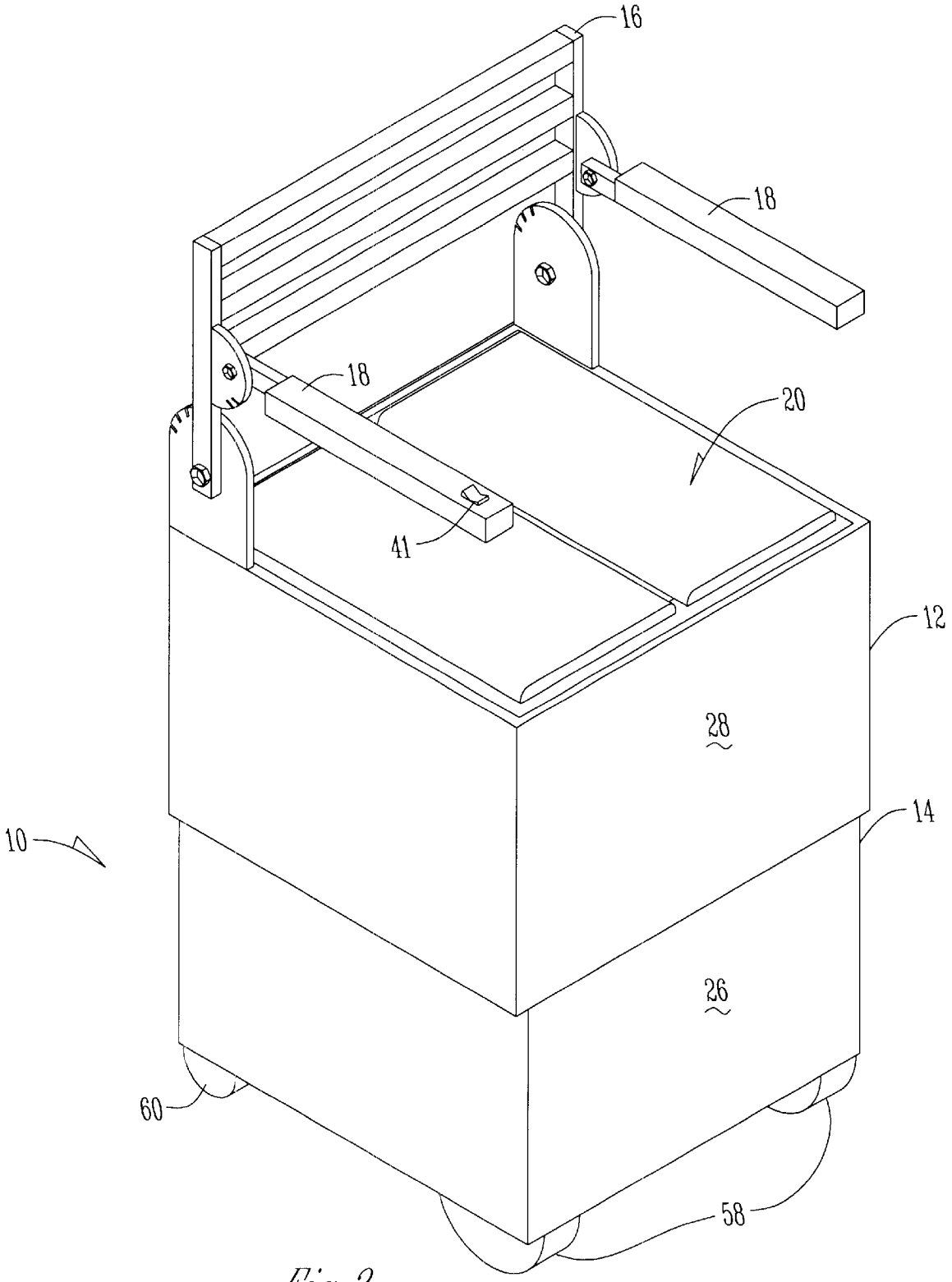
FIG. 2 is a view similar to FIG. 1 showing the seat in a raised position.

The wheelchair of the present invention is generally designated by the reference numeral 10 in the drawings. As best seen in FIG. 2, the wheelchair 10 includes upper and lower portions 12, 14. The chair 10 includes a backrest 16, and a pair of armrests 18. Preferably, the armrests 18 are pivotally connected to the backrest 16 so that the armrests can be moved out of their forwardly-extending position shown in FIGS. 1 and 2. The backrest 16 is preferably pivotally mounted to the upper portion 12 so that it can be folded forwardly and downwardly against the seat of the wheelchair 10 with the armrests 18 folded against the backrest 16, as shown in broken lines in FIG. 4. The chair 10 also includes a seat 20 on the upper portion 12.

Figure 4:
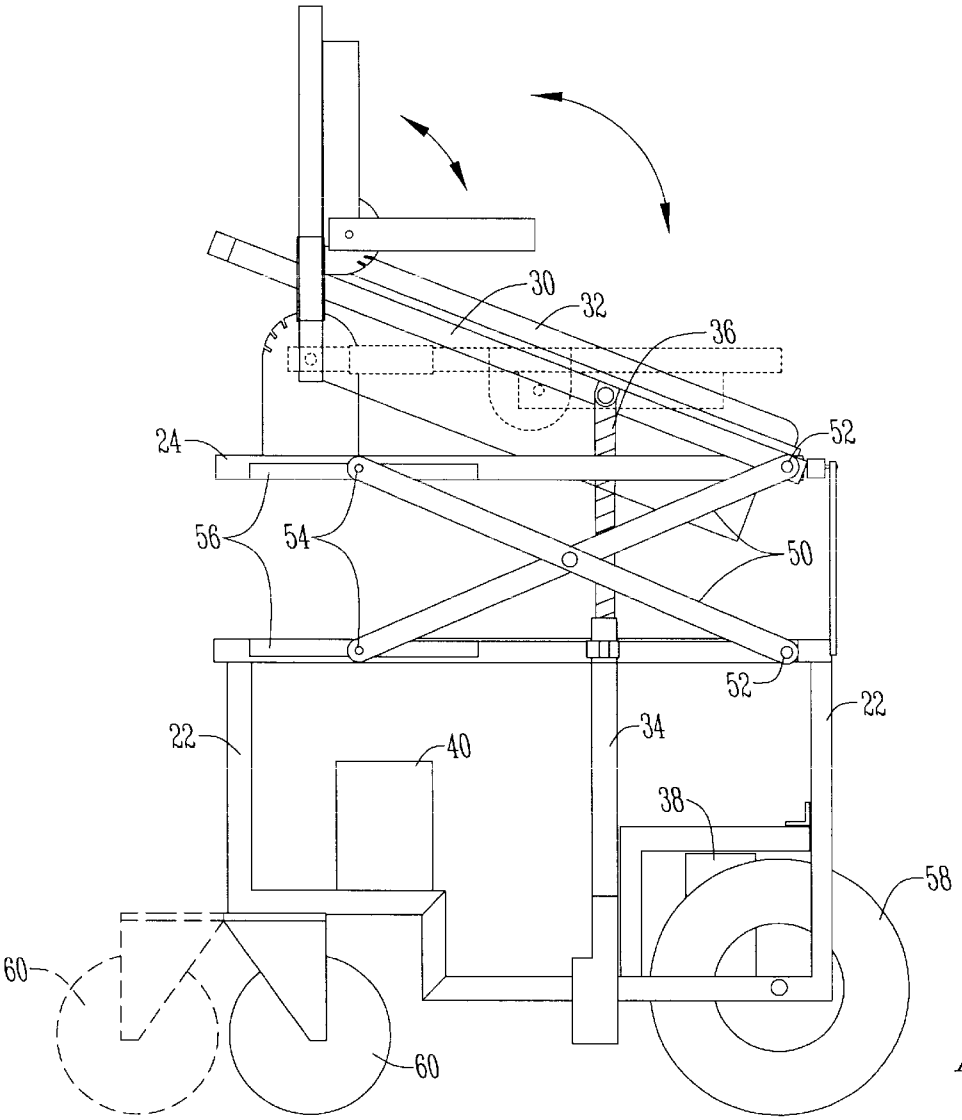
FIG. 4 is a side elevation view of the wheelchair, with the outer housing removed, with the seat partially raised and tilted.
Figure 5:
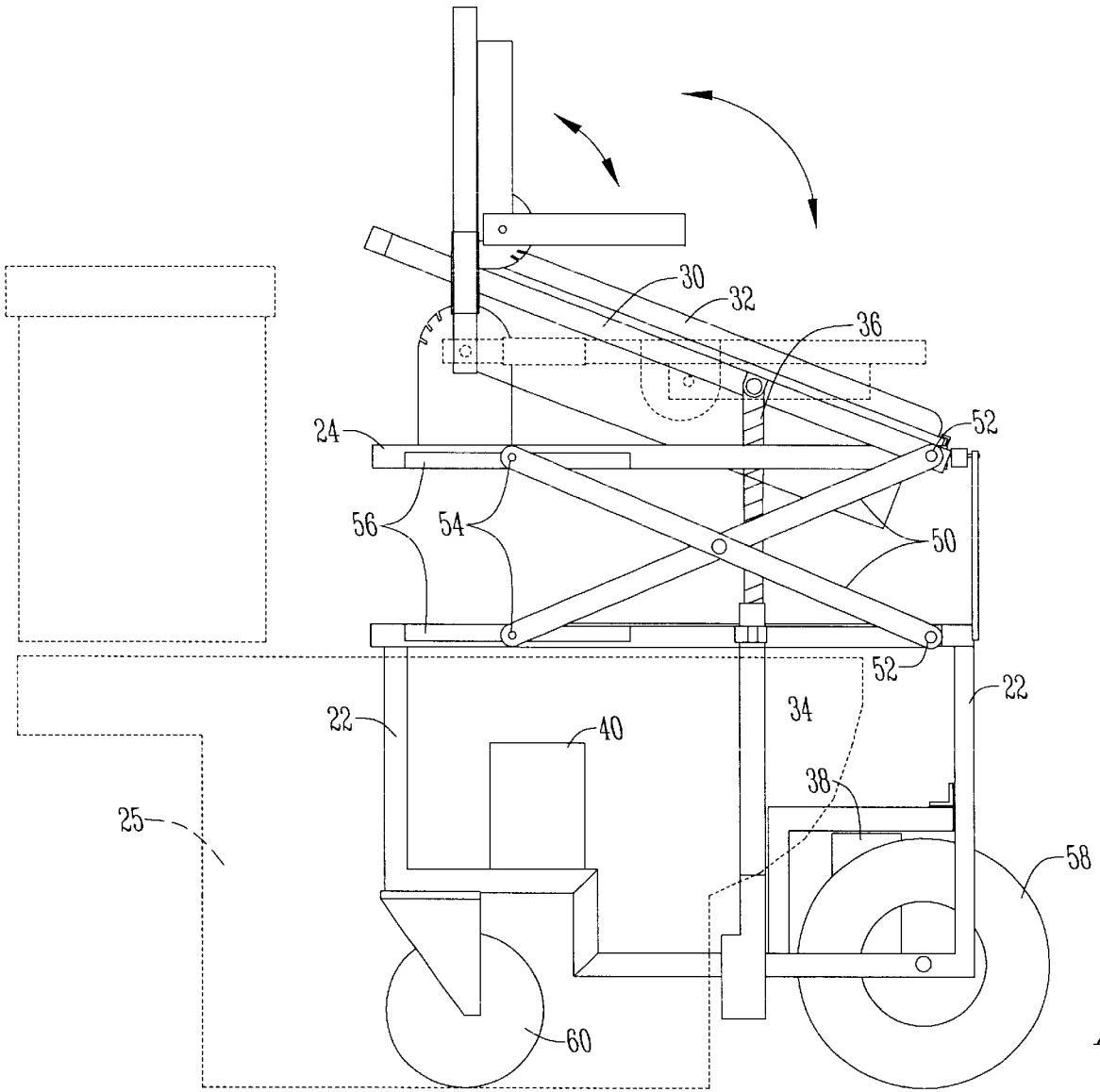
FIG. 5 is a view similar to FIG. 4 showing the wheelchair backed into position around a toilet.
Figure 6:
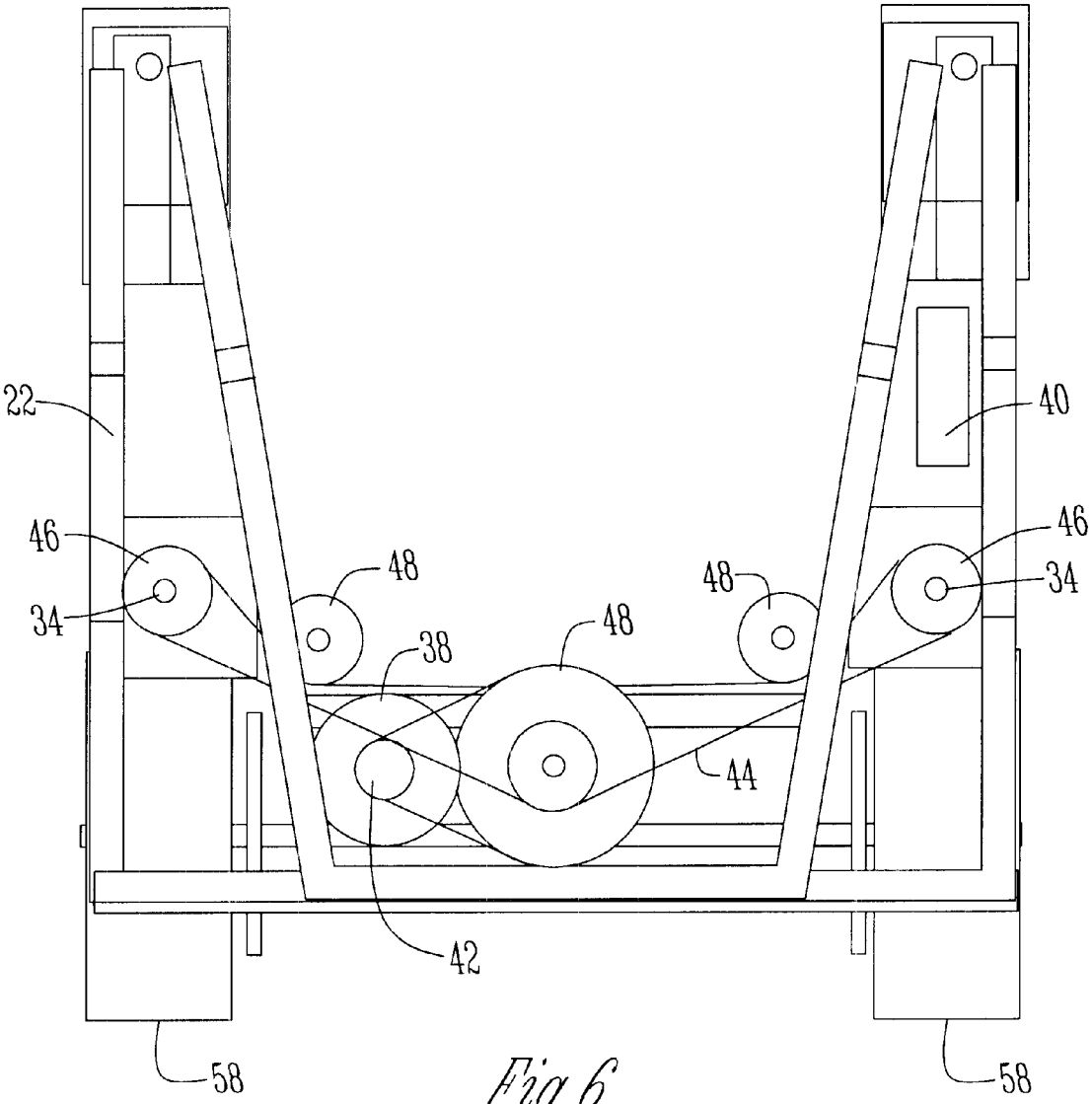
FIG. 6 is a top plan view of the lower frame member of the present invention.
Figure 7:
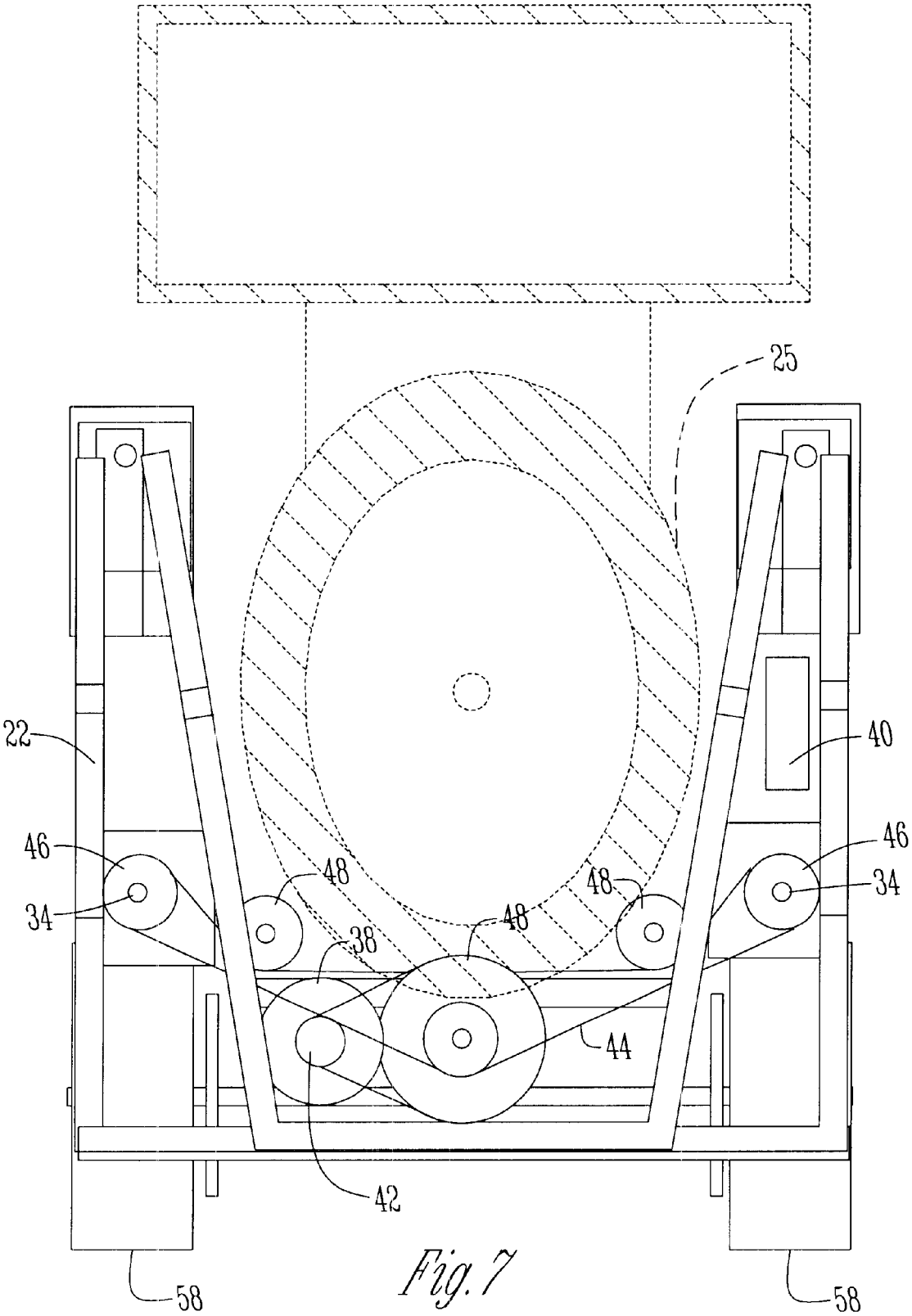
FIG. 7 is a view similar to FIG. 6 showing the lower frame member positioned around a toilet.

The framework of the wheelchair 10 is shown in FIGS. 4–9. More particularly, the wheelchair 10 includes a lower frame member 22 and an upper frame member 24. As seen in FIG. 6, the lower frame member 22 is U-shaped, such that the wheelchair can be backed around a toilet 25, as shown in FIGS. 5 and 7. The lower frame member 22 is surrounded on the opposite sides and the front by a housing or cabinet 26. Similarly, the upper frame member 24 is enclosed with an upper housing 28.

The seat includes a perimeter frame 30 which has a forward edge pivotally connected to the upper frame member 24. The rearward edge of the seat frame 30 is releasably secured to the upper frame member 24 by a latch (not shown) which can be engaged or disengaged by a person sitting in the wheelchair 10. The seat 20 also includes a pair of cushions 32 which can be moved laterally on the seat frame 30 between a normal position, shown in solid lines in FIGS. 1–3 and 8, and an open position, shown in broken lines in FIG. 8. In the open position, the seat cushions 32 are spaced apart so that a person sitting on the wheelchair 10 can use the toilet.

Figure 8:
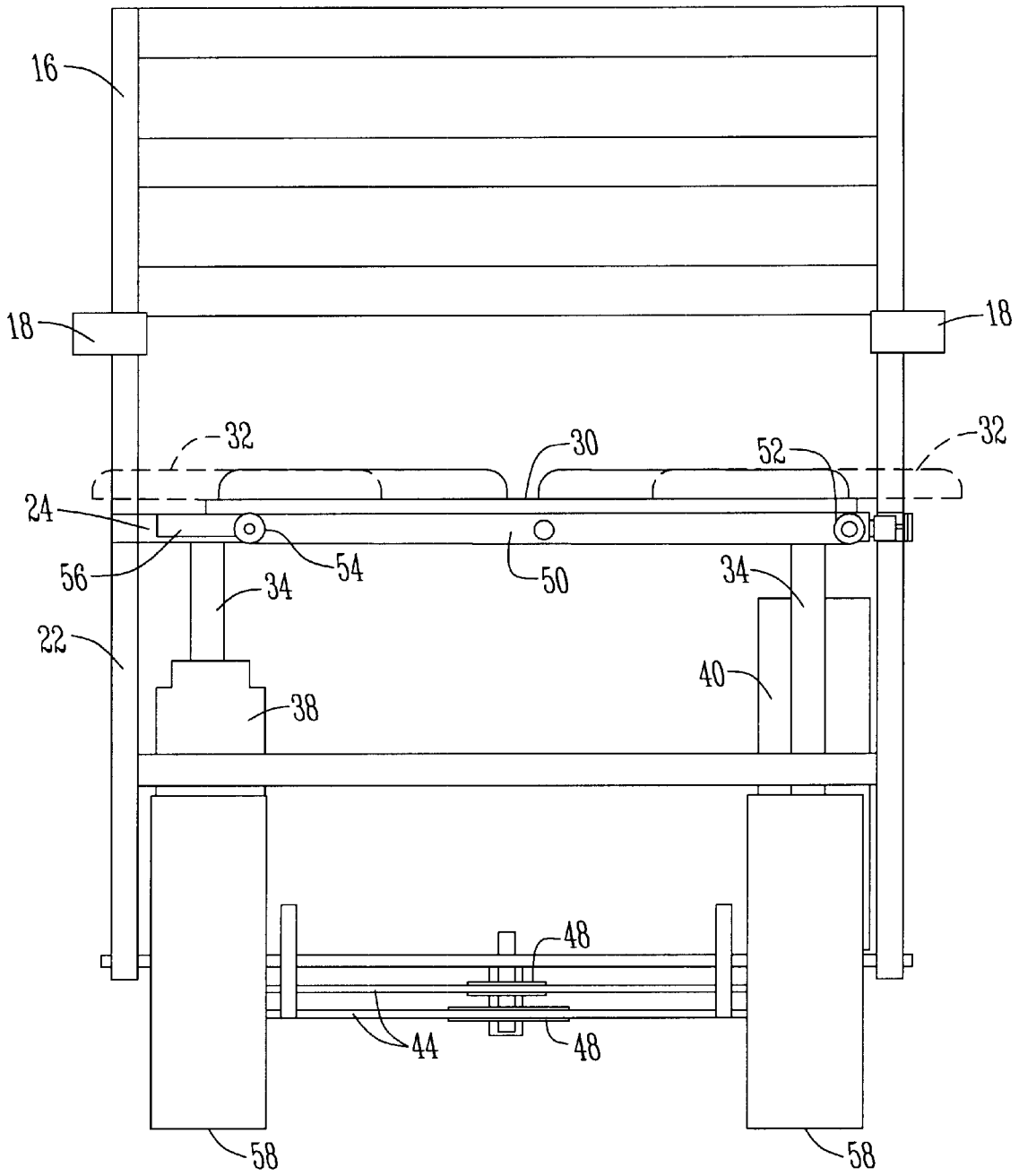
FIG. 8 is a front plan view showing the wheelchair in a lowered position, with the housing removed for clarity.
Figure 9:
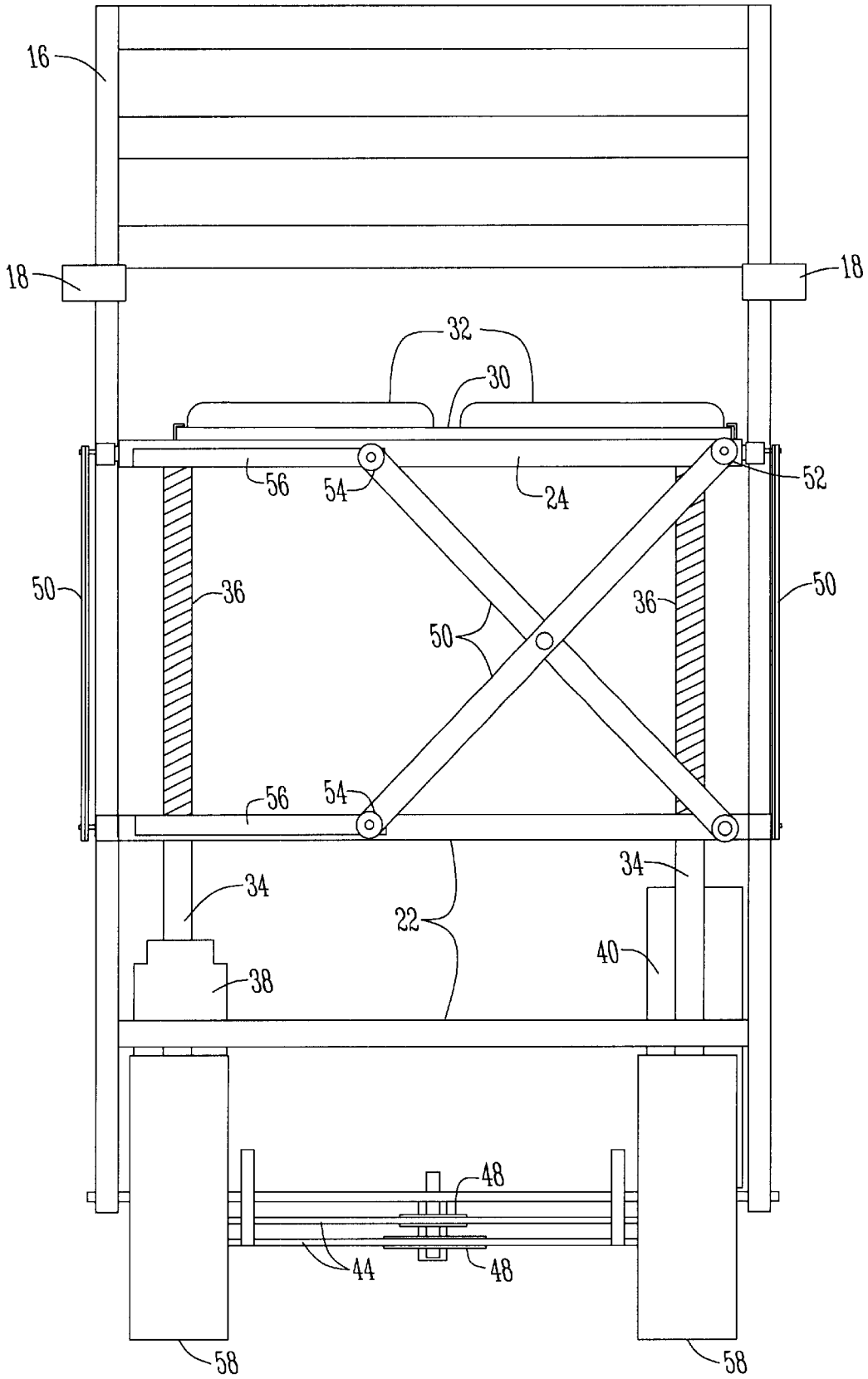
FIG. 9 is a view similar to FIG. 8 showing the wheelchair in a raised position.

A lift mechanism is provided for raising, lowering and tilting the seat 20. More particularly, the lift mechanism includes a pair of hollow tubes 34 mounted on the lower frame member 22 and extending in a vertical orientation. The tubes 34 include internal threads at the upper ends thereof. Each tube 34 is adjacent one of the sides of the lower frame member, as best seen in FIGS. 6, 8 and 9. A threaded shaft or screw 36 is threadably received in each of the tubes 34. Each screw 36 has an upper end that is connected to the seat frame 30, as best seen in FIG. 4.

Figure 3:
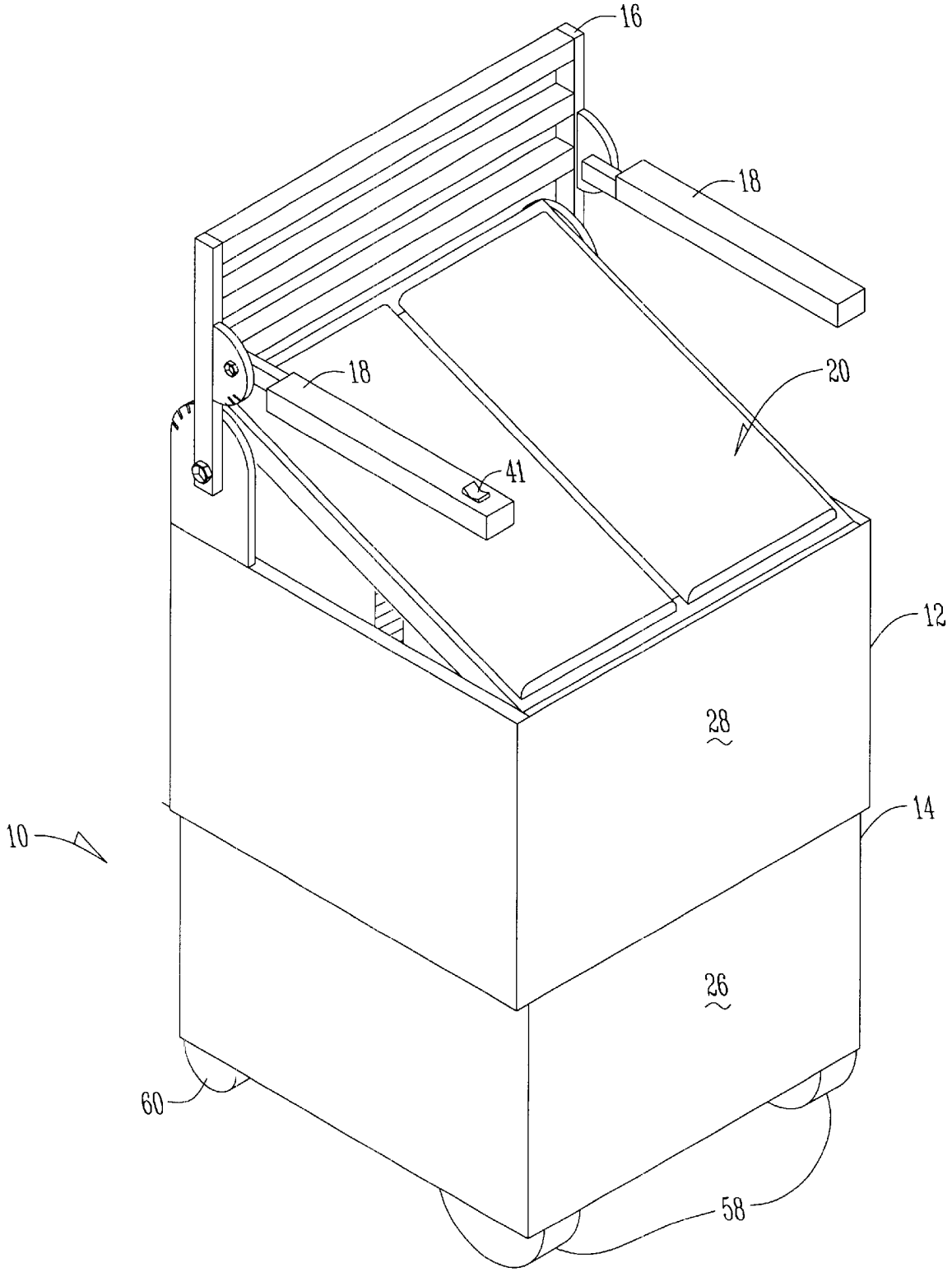
FIG. 3 is a view similar to FIG. 1 showing the seat in a tilted position.

A reversible motor 38 is mounted within the lower frame member 22. The motor 38 is powered by a battery 40, which is also mounted in the lower frame member 22. Actuation of the motor 38 is controlled by a switch 41, which preferably is mounted upon one of the armrests 18, as seen in FIGS. 1–3. The switch 41 may be any conventional switch, such as rocker switch or a toggle switch, and is preferably a direct circuit to the motor 38, without relays. The motor 38 includes a drive shaft 42, which is operatively connected to the tubes 34 for rotating the tubes in opposite directions. The drive shaft 42 may be connected to the tubes 34 via a drive belt or chain 44 extending around pulleys or sprockets 46 on the tubes 34 and idler pulleys or sprockets 48, which are mounted on the lower frame member 22. Thus, actuation of the motor 38 in one direction rotates the tubes 34 so as to extend the screws 36 and thereby lift the seat 20 and upper frame member 24, if the seat 20 and upper frame member 24 are latched together. If the seat 20 is unlatched from the upper frame member 24, extension of the screws 36 tilts the seat 20 forwardly. After the seat 20 is fully tilted, approximately 30° as seen in FIG. 4, continued extension of the screws 36 will raise the seat 20 and upper frame 24 to help a person stand from the wheelchair 10 or sit into the wheelchair from a standing position. The latch is designed so as to be releasable only when the seat 20 is in its lowered position, thereby preventing accidental tilting of the seat after it has been raised. Actuation of the motor 38 in the opposite direction rotates the tubes 34 in the opposite direction such that the screws 36 are retracted, thereby lowering the seat 20.

By rotating the tubes 34, rather than the screws 36 as in the prior art, the screws can be extended virtually their full length. Also, the screws 36 may be longer than the tubes 34, and extend out the bottom end of the tubes when fully retracted.

The weight of a person in the wheelchair 10 is supported by the tubes 34 and screws 36, rather than on the frame. Thus, the lifting force generated by the lift mechanism is directly beneath the load. Accordingly, the frame can be minimized in size and weight. The minimized size of the lift mechanism also saves space within the lower frame member 22, which provides more clearance for positioning the chair 10 around the toilet 25. This structure of the lift mechanism also allows utilization of substantially the full length of the screws 36, thereby maximizing the lift height while minimizing the structural dimensions. In comparison, a conventional lift mechanism or linear actuator which turns the screw directly can only utilize approximately ½ of the screw length.

The lifting mechanism also will not accidentally drop the chair 10, even in the absence of power, since the screws 36 cannot move without turning the tubes 34.

Scissor-type braces 50 are provided on each side and the front of the wheelchair 10. Each brace 50 includes a first end 52 pivotally connected to the corresponding lower or upper frame member 22, 24, and a second end 54 slidably received within a track 56 on the opposite side of the respective frame member 22, 24. Thus, as the seat and upper frame member 24 are raised or lowered, the braces 50 expand or collapse, respectively, as seen in FIGS. 4 and 9. The braces 50 provide stability for the wheelchair in the raised position.

The wheelchair 10 is provided with four wheels mounted adjacent each corner of the chair. Preferably, the front wheels 58 are pneumatic wheels that provide for a smooth ride. The rear wheels 60 are preferably caster wheels which are free to caster between forward and rearward positions, as best seen in FIG. 4. More particularly, when the wheelchair 10 is rolled in a forward direction, the rear wheels 60 caster to a rearward position, shown in broken lines in FIG. 4, so as to define an elongated footprint between the front and rear wheels 58, 60. When the wheelchair 10 is rolled rearwardly, the rear caster wheels 60 caster to a forward position, shown in solid lines in FIG. 4, thereby defining a shorter footprint between the front and rear wheels 58, 60. The shorter footprint is advantageous for maneuvering and positioning the wheelchair 10 around the toilet 25, as seen in FIGS. 5 and 7. Brakes may be provided on one or more of the wheels.

It is understood that one or more additional motors may be provided within the lower frame member 22 to drive the front wheels 58. A separate reversible motor can be provided for each of the front wheels 58, with the motors being driven in the same direction such that the wheels 58 both rotate forwardly or rearwardly, and the motors being operated in opposite directions to one another so that one of the wheels 58 is rotating forwardly and the other is rotating rearwardly so as to turn the wheelchair 10. Switches can be provided on the armrests 16 for controlling the wheel drive motor or motors.

A footrest (not shown) may be provided on the upper portion 12 of the wheelchair 10 so as to move up and down with the seat 20. The footrest maybe retractable and adjustable to accommodate people with different length legs.

The wheelchair 10 has great versatility in usage. The wheelchair 10 is 20" wide so as to easily pass through a standard 24" doorway. In a lowered position the seat 20 of the wheelchair 10 is approximately 20" above a floor and can be raised approximately 17". The seat 20 is approximately 24" deep. These dimensions are representative of a preferred embodiment, but may be modified as needed. With the armrests 18 folded against the backrest 16, and the backrest folded down against the seat 20, the chair is approximately 22" high for easy storage and transport.

In addition to being useful over a toilet while in the lowered position, as shown in FIGS. 5 and 7, the wheelchair 10 can be easily pulled up to a table such that a person in the chair can extend his/her legs under the table. In a raised position, a person sitting in the wheelchair 10 can reach shelves in a cupboard above a countertop. The height of the wheelchair 10 can also be adjusted to match the height of a bed, to facilitate movement of a person between the wheelchair 10 and the bed. The armrests 18 can be folded to a position adjacent the backrest 16 to allow a person to move laterally between the bed and chair and for easier use of the toilet. The seat cushion 32 adjacent the bed can be moved laterally to the open position so as to be closer to the bed.

The ability to tilt the seat 20 also makes it easier for a person to sit into and stand from the wheelchair 10. The tilted seat 20 catches or supports the person's weight at a higher elevation, as compared to a standard chair or wheelchair. Thus, a person can get into and out of the wheelchair 10 with less effort.

Thus, it can be seen that the present invention accomplishes at least all of the stated objectives.

It is understood that the lift mechanism for the wheelchair 10 can be used for other applications wherein a load needs to be lifted.

The preferred embodiment of the present invention has been set forth in the drawings and specification. Although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A wheelchair having a height adjustable and tiltable seat, comprising:

a lower frame member;

an upper frame member;

a seat having a forward edge pivotally connected to the upper frame member and a rearward edge releasably secured to the upper frame member;

an extensible and retractable lift mechanism extending between the lower frame member and the seat so as to raise the seat and upper frame member when the rearward edge of the seat is secured to the upper frame member and so as to tilt the seat forwardly when the rearward edge of the seat is released from the upper frame member; and side support braces extending between the upper and lower frame members on each side thereof for front and rear stability of the wheelchair when the seat is raised.

2. The wheelchair of claim 1 further comprising a front support brace extending between the upper and lower frame members for lateral stability of the wheelchair when the seat is raised.

3. The wheelchair of claim 1 wherein the lower frame member is U-shaped so that the wheelchair can be positioned with the seat over a toilet.

4. The wheelchair of claim 1 wherein the seat includes a pair of cushions which are split so as to be movable between a laterally open position for using the toilet and a closed position.

5. The wheelchair of claim 1 further comprising a pair of front wheels mounted on the lower frame member adjacent a front edge thereof, and a pair of rear caster wheels mounted on the lower frame adjacent a rear edge thereof, the caster wheels castering between first and second positions when the wheelchair is rolled forwardly and rearwardly, respectively, such that the wheels define a first footprint when the wheelchair is rolled forwardly and a second footprint when the wheelchair is rolled rearwardly, the second footprint being shorter than the first footprint.

6. The wheelchair of claim 1 further comprising a backrest and armrest, the armrests being pivotally connected to the backrest so as to fold against the backrest, and the backrest being pivotally mounted so as to fold forwardly and downwardly against the seat.

7. A wheelchair, comprising:

a lower frame member;

an upper frame member connected to the lower frame member;

a seat on the upper frame member;

a lift mechanism for moving the seat between raised and lowered positions;

the lift mechanism including:

a pair of hollow threaded tubes rotatably mounted on the lower frame member;

a pair of threaded shafts threadably received in each of the tubes and each shaft having an upper end connected to the seat; and a reversible motor operatively connected to each of the tubes to rotate the tubes in a first direction so as to extend the shafts and thereby raise the seat, and to rotate the tubes in an opposite second direction so as to retract the shafts and thereby lower the seat;

the seat having a forward edge pivotally connected to the upper frame and a rearward edge releasably secured to the upper frame, whereby the upper frame is raised with the seat when the rearward edge is secured to the frame and the shafts are extended, and whereby the seat is tilted forwardly when the rearward edge is released from the upper frame and the shafts are extended.

8. A wheelchair, comprising:

a lower frame member;

an upper frame member connected to the lower frame member;

a seat on the upper frame member;

a lift mechanism for moving the seat between raised and lowered positions;

the lift mechanism including:

a pair of hollow threaded tubes rotatably mounted on the lower frame member and being laterally spaced apart;

a pair of threaded shafts threadably received in each of the tubes and each shaft having an upper end connected to the seat;

a reversible motor operatively connected to each of the tubes to rotate the tubes in a first direction so as to extend the shafts and thereby raise the seat, and to rotate the tubes in an opposite second direction so as to retract the shafts and thereby lower the seat; and side support braces extending between the upper and lower frame members on each side thereof for front and rear stability of the wheelchair when the seat is raised.

9. A wheelchair, comprising:

a lower frame member;

an upper frame member connected to the lower frame member;

a seat on the upper frame member;

a lift mechanism for moving the seat between raised and lowered positions;

the lift mechanism including:

a pair of hollow threaded tubes rotatably mounted on the lower frame member and being laterally spaced apart;

a pair of threaded shafts threadably received in each of the tubes and each shaft having an upper end connected to the seat;

a reversible motor operatively connected to each of the tubes to rotate the tubes in a first direction so as to extend the shafts and thereby raise the seat, and to rotate the tubes in an opposite second direction so as to retract the shafts and thereby lower the seat; and a front support brace extending between the upper and lower frame members for lateral stability of the wheelchair when the seat is raised.

10. A wheelchair, comprising:

a lower frame member;

an upper frame member connected to the lower frame member;

a seat on the upper frame member;

a lift mechanism for moving the seat between raised and lowered positions;

the lift mechanism including:

a pair of hollow threaded tubes rotatably mounted on the lower frame member and being laterally spaced apart;

a pair of threaded shafts threadably received in each of the tubes and each shaft having an upper end connected to the seat;

a reversible motor operatively connected to each of the tubes to rotate the tubes in a first direction so as to extend the shafts and thereby raise the seat, and to rotate the tubes in an opposite second direction so as to retract the shafts and thereby lower the seat; and the lower frame member being U-shaped so that the wheelchair can be positioned with the seat over a toilet.

11. The wheelchair of claim 10 further comprising a battery mounted on the lower frame for powering the motor.

12. The wheelchair of claim 10 further comprising a pair of arm rests, at least one of which has a control for actuating the motor in both directions.

13. The wheelchair of claim 10 further comprising a pair of front wheels mounted on the lower frame adjacent a front edge thereof, and a pair of rear caster wheels mounted on the lower frame member adjacent a rear edge thereof, the caster wheels castering between first and second positions when the wheelchair is rolled forwardly and rearwardly, respectively, such that the wheels define a first footprint when the wheelchair is rolled forwardly and a second footprint when the wheelchair is rolled rearwardly, the second footprint being shorter than the first footprint.

14. The wheelchair of claim 10 wherein the seat includes a pair of cushions which are split so as to be movable between a laterally open position for using the toilet and a closed position.

15. The wheelchair of claim 10 further comprising a backrest and armrests, the armrests being pivotally connected to the backrest so as to fold against the backrest, and the backrest being pivotally mounted so as to fold forwardly and downwardly against the seat.

16. The wheelchair of claim 10 further comprising a switch for actuating the motor.

* * * * *